United States Patent [19]

Shainfeld

[11] Patent Number: 4,944,055

[45] Date of Patent: Jul. 31, 1990

[54] BED WHICH IS CONVERTIBLE INTO EASY CHAIR

[76] Inventor: Oded Shainfeld, 20 Rehov Kehilat Budapest, Tel Aviv, Israel

[21] Appl. No.: 294,357

[22] Filed: Jan. 9, 1989

[30] Foreign Application Priority Data

Feb. 17, 1988 [IL] Israel ..... 85442

[51] Int. Cl.[5] ..... A61G 7/05

[52] U.S. Cl. ..... 5/68; 5/69

[58] Field of Search ..... 5/66, 67, 69, 68, 236 R, 5/237, 238

[56] References Cited

U.S. PATENT DOCUMENTS

| | | | |
|---|---|---|---|
| 3,261,639 | 7/1966 | Phillips | 5/69 |
| 3,681,792 | 8/1972 | Korber | 5/67 |
| 4,188,677 | 2/1980 | Zur | 5/412 |
| 4,258,445 | 3/1981 | Zur | 5/66 |

FOREIGN PATENT DOCUMENTS

| | | | |
|---|---|---|---|
| 644700 | 7/1962 | Canada | 5/69 |
| 2408922 | 7/1975 | Fed. Rep. of Germany | 5/66 |
| 3218278 | 11/1983 | Fed. Rep. of Germany | 5/66 |
| 55298 | 8/1978 | Israel . | |
| 57628 | 6/1979 | Israel . | |
| 59834 | 4/1980 | Israel . | |
| 434612 | 10/1967 | Switzerland | 5/66 |
| 440245 | 12/1935 | United Kingdom | 5/69 |

*Primary Examiner*—Gary L. Smith
*Assistant Examiner*—F. Saether
*Attorney, Agent, or Firm*—Notaro & Michalos

[57] ABSTRACT

A piece of furniture comprises a chassis having a plurality of hinge connections to which a bed structure is connected. The bed structure comprises four parts which are hinged to each other including a back with headrest part, a seat and a two part leg support. The back and one part of the leg support are hingedly connected to the chassis through additional articulated linkages. The piece of furniture is convertible from a bed configuration with all parts of the bed structure aligned with each other, to an easy chair configuration, by the application of selected amounts of load on the parts of the bed structure by a person lying on the structure.

2 Claims, 1 Drawing Sheet

15
16

18

18

X
14
8
9
7
18
13
17
12
6
A
11
Z
19
5
10
1

"X"
14
7
9
8
18
13
17
12
6
"Y"
11
5
19
"Z"
10
1

BED WHICH IS CONVERTIBLE INTO EASY CHAIR

FIELD AND BACKGROUND OF THE INVENTION

The present invention relates to a bed which can be converted into an easy chair and vice versa.

There are known a great number of chairs which from an upright sitting position can be converted into the reclining position of the person occupying the chair as well as so called relaxaton or easy chairs the position of which can be changed at will, such as described in Israel Patent Nos. 55298, 57628 and 59834 . All such models have certain advantages over other models while others are disadvantageous in certain respeats. The subject of this invention could be classified as belonging to the group of relaxation chairs.

SUMMARY OF THE INVENTION

The relaxation or easy chair according to the present invention comprises a framework or chassis structure to which is hingedly connected in a manner which will be defined: a hingedly interconnected four part structure comprising a back rest, a seat and a two part let support. The load of a reclining body of a person exerting pressure on different parts of the structure changes the position of the parts.

BRIEF DESCRIPTION OF DRAWINGS

The invention will now be described with reference to the annexed drawings, in which.

DECRIPTION OF THE PREFERRED EMBODIMENTS

Figures 1, 2, 3, 4, 5:
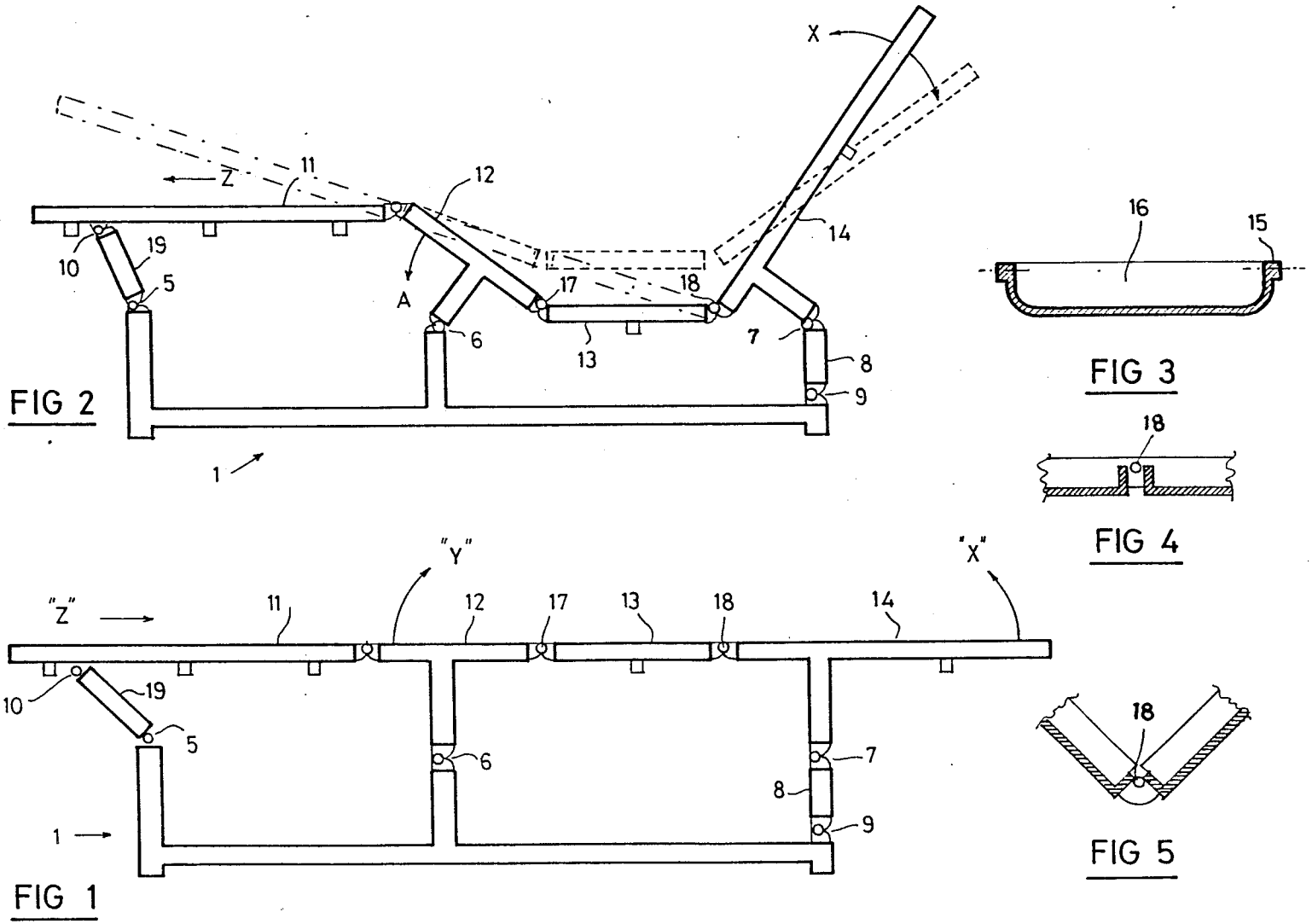
FIG. 1 is a purely schematical lateral, elevational view of the invention in the "bed" position.
FIG. 2 is a like view of the invention in a "relaxation chair" position.
FIG. 3 is an elevational cross sectional view (also purely schematical) of one of the parts of the structure.
FIGS. 4 and 5 illustrate details of hinges connecting upholstered parts.

Turning first to FIG. 1, the invention comprises two major parts, the supporting chassis 1 and the structure on which a person lies or sits (hereinafter referred to as the "upper structure"). In the present embodiment, the upper structure which comprises four parts is connected hingedly to the chassis at 5, 6, and 7. At least one of connecting hinges 6 or 7 is "floating" in the sense which will be described.

As stated before, the super structure comprises (in the present embodiment) four parts 11, 12, 13 and 14. Parts 11 and 12 together form a leg support, part 13 is the seat while part 14 is the back and head support.

The said four parts are interconnected by hinge devices (to be described) which will permit smooth movement of the different parts while changing positions. There are provided locking means of whatever conventional type which will permit to lock the bed or chair parts at any position, by immobilizing the parts relative to one another.

In its most advantageous form, the bedstead parts 11, 12, 13 and 14 are each constituted by a four sided shallow tray shaped frame 15 in the concavity of which there being held an upholstered elastic and easily bendable mattress 16 which extends from each of the four parts into the neighbouring one. The hinges 17, 18 connecting first leg support part 12 to part 13 and part 13 to part 14 are placed at the uppermost edges of the tray shaped frames 15, see FIGS. 4 and 5. The result of this resides in that the mattress 16 becomes stretched when the hinge parts of hinges 17, 18 move from a common plane (FIG. 4) to an angle (FIG. 5) so that the position of FIG. 2 is obtained while stretching the mattress which is easier than compressing same.

The new bed/chair arrangement functions in the following manner: When the weight of the body of a person using the bed/chair acts on the seat part 13, that part will be lowered from the position shown in FIG. 1, while the back rest 14 will swing about hinge axis 7 in direction of arrow X, while let support 12 will swing about hinge axis 6 in direction of arrow Y. The second leg support part 11 of the leg support will move in direction of arrow Z—which movement is possible due to a floating hinge. Arm 19 is connected between hinge 10 and hinge 5 to permit the movement of part 11 in the direction of arrow Z. The floating hinge connecting part 14 of the upper-structure with the chassis consist of an arm 8, which at one end is hingedly connected to the part 14 and at its other end, at 9, with the chassis. Such a connection is adaptable to different positions which the respective parts assume. A similar arrangement is present at connection of part 11, with the chassis permitting a parallel movement of part 11 with the chassis.

As shown in FIG. 2, chassis 1 includes a first contact portion which is relatively tall and extends upwardly from the chassis to the hinge 5. The chassis also comprises a second shorter contact portion which is connected to the hinge 6 and a third low contact portion connected to hinge 9. First leg support part 12 and back support part 14 both have T-shaped elevations with a cross piece forming a support for a part of the body and a post connected to respective hinges 6 and 7.

When pressure (of the body) is applied on the back section 14, the opposite to what has been described occurs, i.e. the movement of back 14 is reversed. When pressure of a person's legs acts on parts 11 and 12, the movement of the leg support is reversed. Back and leg supports can be activated separately.

In a further embodiment, one of the two sections of the leg support may be removed, thus the leg support constitutes section 12 only.

As shown in FIG. 2 at the dash-dotted line position, the hinges connecting parts 11, 12, and 13 may be locked with the parts 11, 12, and 13 in a straight line constituting in effect, one rigid part. This requires disconnection of hinge 10 from the chassis.

I claim:

1. A piece of furniture comprising:

a chassis (1) having first, second and third spaced apart contact portions;

a first arm (19) pivotally mounted to said first contact portion at a first hinge (5);

a second arm (8) having one end pivotally mounted to said third contact portion at a second hinge (9), said second arm having an opposite end;

a upper-structure connected at a plurality of hinges to said first and second arms and to said second contact portion, said upper-structure comprising a back support (14) having opposite ends, said back support having a T-shaped elevation with a cross piece for supporting a mattress and a post rigidly connected to said cross piece, said post of said back support being pivotally connected directly to said opposite end of second arm at a third hinge (7) located intermediate said opposite ends of said back support, and said back support being connected to said chassis only by said third hinge, a seat (13) having one end connected only at a fourth hinge (18) to one end of said back support, said seat having an opposite end, a first leg support (12) having one end connected only at a fifth hinge (17) to said opposite end of said seat, said first leg support having an opposite end and having a T-shaped elevation with a cross piece for supporting a mattress and a post rigidly connected to said cross piece of said first leg support, said post of said first leg support being directly pivotally connected at a sixth hinge (6) to said second contact portion and at an intermediate location on said first leg support between said one end and said opposite end of said first leg support, said seat being connected only to said back support and said first leg support, and a second leg support (11) having one end pivotally connected at a seventh hinge to said opposite end of said first leg support, said second leg support having an opposite end and being pivotally connected to said first arm at an eighth hinge (10) and at a location intermediate said one end and said opposite end of said second leg support; and at least some of said hinges being lockable for locking a relative position between said first and second arms and between said back support, said seat, and said first and second leg supports;

said back support, said seat, and said first and second leg supports each comprising a frame defining a concave space for receiving a single mattress spanning said back support, said seat, and said first and second leg supports, each of said fourth, fifth and seventh hinges being connected at upper edges of said frames forming said respective back support, seat and first and second leg supports.

2. A piece of furniture according to claim 1 wherein said first contact portion is relatively tall compared to said third contact portion and said second contact portion is of intermediate height with respect to said first and second contact portions.

* * * * *